US007350508B1

(12) United States Patent
Chapman et al.

(10) Patent No.: US 7,350,508 B1
(45) Date of Patent: Apr. 1, 2008

(54) ADVANCE ARRANGEMENTS

(75) Inventors: Leslie Edwin Chapman, Chatham (GB); Rodney Dyason, Chatham (GB)

(73) Assignee: Delphi Technologies, Inc., Troy, MI (US)

( * ) Notice: Subject to any disclaimer, the term of this patent is extended or adjusted under 35 U.S.C. 154(b) by 87 days.

(21) Appl. No.: 11/546,636

(22) Filed: Oct. 12, 2006

(51) Int. Cl.
*F02M 37/04* (2006.01)

(52) U.S. Cl. ..... 123/502; 123/179.13; 123/449; 123/450; 123/500; 123/501; 123/503

(58) Field of Classification Search ..... 123/179.13, 123/449, 450, 500, 501, 502, 503
See application file for complete search history.

(56) References Cited

U.S. PATENT DOCUMENTS

| | | | | |
|---|---|---|---|---|
| 4,197,059 | A * | 4/1980 | Simko | 417/282 |
| 4,408,591 | A | 10/1983 | Nakamura | |
| 4,610,234 | A * | 9/1986 | Sakuranaka | 123/502 |
| 4,798,189 | A * | 1/1989 | Thornthwaite et al. | 123/502 |
| 6,041,759 | A * | 3/2000 | Burborough | 123/501 |
| 6,718,951 | B2 * | 4/2004 | Hopley | 123/502 |
| 6,792,922 | B2 * | 9/2004 | Simon et al. | 123/502 |
| 6,941,932 | B2 * | 9/2005 | Hopley et al. | 123/502 |
| 2007/0023013 | A1 * | 2/2007 | Chapman et al. | 123/500 |

FOREIGN PATENT DOCUMENTS

| | | |
|---|---|---|
| EP | 1356196 | 10/2003 |

* cited by examiner

*Primary Examiner*—Stephen K. Cronin
*Assistant Examiner*—J. Page Hufty
(74) *Attorney, Agent, or Firm*—David P. Wood

(57) ABSTRACT

An advance arrangement for use in controlling timing of fuel delivery by a fuel pump for use in an engine comprises an advance piston (12) which is slidable within a first bore (14) and which cooperates, in use, with a cam arrangement of a fuel pump to adjust the timing of fuel delivery by the pump. A surface associated with the advance piston (12) is exposed to fuel pressure within a first control chamber (38). The pressure of fuel within the first control chamber (38) is controlled by means of a servo piston (24) which is slidable within a further bore (22) provided in the advance piston (12). The servo piston (24) is responsive to speed dependent fuel pressure variations within a servo control chamber (37), thereby to permit adjustment of the timing in response to engine speed. A light load piston (26) is moveable relative to the advance piston (12) against the action of a light load control spring (28) in response to load dependent fuel pressure variations within a light load control chamber (60), thereby to adjust the timing under light load conditions. The light load piston (26) is carried within a cold cranking sleeve (120) which is slidable within the first bore (14) against the action of a cold cranking control spring (128) in response to fuel pressure variations within a cold cranking control chamber (134). Thus, the cranking control spring (128) acts, in use, to slide the cold cranking sleeve (120) a predetermined distance in the advance direction and fuel pressure variations within the control chamber (134) serve to slide the cold cranking sleeve (120) back in the retard direction.

12 Claims, 6 Drawing Sheets

ADVANCE ARRANGEMENTS

Figure 1:
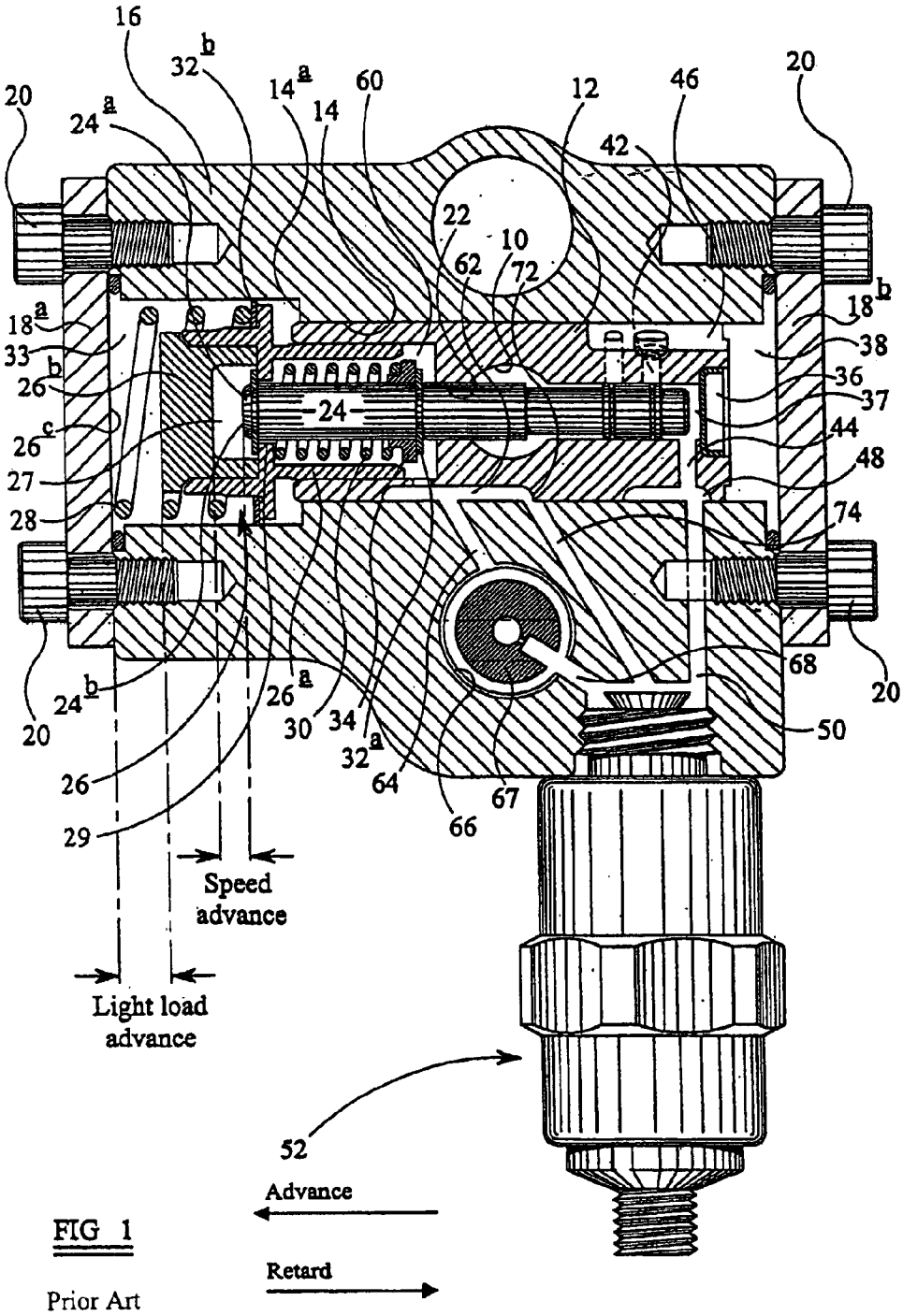
FIG 1 Prior Art

The invention relates to an advance arrangement for use in controlling the timing of fuel delivery by a high pressure fuel pump intended for use in a compression ignition internal combustion engine.

In a conventional rotary fuel pump, the angular position of a cam ring is adjusted by means of a servo advance arrangement. One known type of servo advance arrangement is described in our co-pending European patent application EP 1356196. The servo advance arrangement includes a main piston (referred to as the advance piston) which cooperates with a cam arrangement of the fuel pump to adjust the timing of fuel pump delivery. The advance piston is responsive to fuel pressure changes within an advance piston control chamber (the main advance control chamber). If pressure in the main advance control chamber increases, the advance piston is caused to move in a first direction so as to advance the timing of fuel delivery. If pressure in the main advance control chamber is reduced, the advance piston is caused to move in an opposite direction to retard the timing of fuel delivery.

A servo piston is operable in response to a transfer pressure signal (a signal dependent upon engine speed) to determine the position of the main advance piston. For certain positions of the servo piston, the main advance control chamber receives fuel at transfer pressure by means of a supply port provided in the advance piston and a flat machined on the outer surface of the advance piston. In such circumstances increased fuel pressure within the main advance control chamber causes the advance piston to move to advance engine timing. For other positions of the servo piston, a drain port is uncovered causing pressure within the main advance control chamber to decrease and, hence, the advance piston is moved to retard engine timing. The supply port and the drain port are aligned on a common axis on the advance piston so that both communicate with the flat, either to provide a flow route into the main advance control chamber through the supply port or a flow route out of the main advance control chamber through the drain port. The servo advance arrangement is also provided with a light load mechanism to permit the timing of fuel delivery by the pump to be varied when the engine operates under light load conditions.

The above advance arrangement (described in the Applicant's co-pending application EP 1356196) was designed to meet specific emission regulations (Tier 2 Emission Regulations Europe and Tier 2 Emissions Regulations U.S.). Further, more stringent regulations (e.g. Tier 3 Emission Regulations Europe and Tier 3 Emissions Regulations U.S.) however have reduced the level of nitrous oxide that can be emitted. Due to the reduction in this lower limit the full load rated speed timing of Tier 3 engines needs to be retarded significantly. As a consequence of this the pump timing for cold starting is also significantly retarded and so engines fitted with the above advance arrangement do not have the required cold starting performance.

Although the advance arrangement associated with a fuel injection pump can adjust the timing of fuel injection in accordance with, amongst other things, the light load operating conditions of the associated internal combustion engine, the adjustment of a datum timing setting in relation to which adjustment by the advance arrangement takes place, is achieved by physically securing the pump to the associated engine in a predetermined angular location in relation to the pump drive mechanism. Accordingly, adjustment of the datum position is particularly inconvenient, and may be extremely difficult and time consuming in that the engine must be run, and then stopped to permit datum adjustment, and in many installations access to the pump mounting flange in order to effect adjustment of the physical position of the pump relative to the engine, is restricted.

The Applicant's granted European patent EP 1035311 describes a dynamic timing adjustor in which an externally accessible, adjustable abutment cooperates with the light load piston to permit setting of a rest position of the light load piston relative to the housing of the advance arrangement and thereby to permit adjustment, from the exterior of said housing, of the datum setting from which the advance arrangement adjusts fuel injection timing.

It is noted however that since the timing adjustor acts directly on the light load advance (LLA) piston it has the disadvantage that the LLA spring pre-load can be altered thereby affecting engine performance.

It is an object of the present invention therefore to remove or alleviate at least one of the aforementioned problems.

According to a first aspect of the present invention, there is provided an advance arrangement for use in controlling timing of fuel delivery by a fuel pump for use in an engine comprising;

an advance piston which is slidable within a first bore and which cooperates, in use, with a cam arrangement of a fuel pump to adjust the timing of fuel delivery by the pump, a surface associated with the advance piston being exposed to fuel pressure within a first control chamber and the advance piston being slidable within the bore in either an advance or a retard direction to advance or retard, respectively, the timing of the fuel pump delivery, a servo piston which is slidable within a further bore provided in the advance piston to control the pressure of fuel within the first control chamber, the servo piston being responsive to speed dependent fuel pressure variations within a servo control chamber, thereby to permit adjustment of the timing in response to engine speed, and a light load piston moveable relative to the advance piston against the action of a light load control spring in response to fuel pressure variations within a light load control chamber, wherein the light load piston is carried within a cold cranking sleeve, the sleeve being slidable within the first bore against the action of a cold cranking control spring in response to fuel pressure variations within a cold cranking control chamber such that the cranking control spring acts, in use, to slide the sleeve a predetermined distance in the advance direction and fuel pressure variations within the control chamber serve to slide the sleeve back in the retard direction.

The present invention provides an advance arrangement with improved cold starting performance. A cold cranking advance mechanism is provided in which some of the components of the advance arrangement (servo piston and light load piston) are carried within a cranking advance sleeve which is slidable within the first bore of the advance arrangement.

The cold cranking sleeve is biased by a cold cranking control spring such that the whole advance arrangement is, prior to engine start up, pushed into the advance direction. This therefore improves the cold starting performance of the engine and overcomes the problems detailed above in relation to the advance arrangement described in EP 1356196.

Upon engine start up fuel flows into a cold cranking control chamber which acts to return the cold cranking sleeve back in the retard direction towards a normal running position.

The normal running position is conveniently the position from which the advance arrangement adjusts fuel injection timing.

Preferably the advance arrangement is moved by between two and four degrees of advance by the cranking control spring.

Preferably the advance arrangement according to the present invention additionally comprises a dynamic timing adjustment arrangement. Such a timing adjustment arrangement comprises an externally adjustable abutment member in the advance arrangement housing which cooperates with the cold cranking sleeve in order to permit small adjustments to the normal running position of the sleeve relative to the housing.

Previously, such timing adjustment arrangement acted directly upon the light load piston. Although this allowed adjustment of the datum setting of the advance arrangement it also altered the pre-load of the light load spring which had detrimental effects on engine performance.

In the present invention the dynamic timing adjustment arrangement acts upon the cold cranking sleeve and not the light load piston/spring. This therefore means that adjusting the timing datum of the present invention does not alter the light load spring pre-load.

Conveniently the abutment member comprises a post which cooperates with a slot in the surface of the sleeve.

Conveniently the cold cranking control spring is located at one end of the sleeve and acts upon a step in the first bore in order to bias the sleeve into the advance direction.

The first bore of the advance arrangement extends through a housing. Conveniently, this bore is closed at one end by a cold cranking advance housing and a cold cranking advance piston, which is operably connected to a second end of the sleeve and is slidably mounted within the housing, the piston and housing serving to define the cold cranking control chamber.

Conveniently, the second end of the sleeve is closed by a cold cranking plug and it is the plug that provides the connection between the cold cranking advance piston and the sleeve.

Conveniently, the cold cranking plug, first bore and cold cranking housing define a further chamber which can be in fluid communication with the cold cranking control chamber depending on the position of the cold cranking piston within the cold cranking housing.

Conveniently, the piston comprises a passage from the control chamber to an annular recess on the surface of the piston. Depending on the position of the piston within the cold cranking housing this passage and recess permit the further chamber to be in fluid communication with the cranking control chamber. At certain piston positions within the housing the annular recess on the surface of the piston is closed off by the housing wall. As the piston moves in the retard direction the recess is uncovered and the fluid communication channel between the cold cranking chamber and the further chamber is opened up.

Further features of the invention are noted below.

In a preferred embodiment, the light load piston is shaped to define, in part, a servo piston chamber in communication with the light load control chamber, whereby fuel pressure within the servo piston chamber acts on an end of the servo piston remote from the servo control chamber.

The light load control chamber preferably communicates with the servo piston chamber through a clearance defined between respective surfaces of the servo piston and the light load piston.

The advance arrangement preferably includes an adjustment arrangement for permitting the extent of travel of the servo piston and/or the light load piston to be adjusted.

Preferably, the light load piston includes first and second parts which are moveable relative to one another to permit adjustment of the extent of travel of at least one of the light load piston and the servo piston.

The second part of the light load piston is preferably provided with a blind bore which defines, together with an end surface of the servo piston, the servo piston chamber.

The formation of the light load piston in first and second parts which are movable relative to one another permits the extent of travel of the servo piston and/or the extent of travel of the light load piston to be adjusted prior to installation in the pump. Conveniently, the first and second parts are in screw threaded connection such that the extent of travel of the piston(s) is varied depending upon how far one part is screwed into the other.

The advance arrangement may also include a temperature control valve operable to control the application of fuel to the light load piston depending upon the engine temperature, thereby to permit adjustment of the timing of fuel delivery depending on engine temperature.

Preferably, the temperature control valve is arranged such that, when the engine temperature is less than a predetermined temperature, the temperature control valve is activated so as to permit fuel pressure within the light load control chamber to be increased, the temperature control valve being de-activated when the engine temperature exceeds the predetermined temperature.

The advance piston is typically arranged to be moveable within the first bore in an advance direction, in which the timing of fuelling delivery by the pump is advanced, and a retard direction in which the timing of fuelling delivery by the pump is retarded. Preferably, the advance arrangement further comprises a cold advance supply passage through which fuel is supplied to the light load control chamber when the temperature control valve is activated, the cold advance supply passage being arranged to communicate with the light load control chamber only when the extent of movement of the advance piston in the advance direction is less than a predetermined amount.

Preferably, the advance piston has an outer surface provided with a recess in communication with the light load control chamber which defines a control edge, and whereby communication between the cold advance supply passage and the light load control chamber is broken when the control edge becomes misaligned with the cold advance supply passage upon movement of the advance piston beyond the predetermined amount.

The advance arrangement may also include a light load supply passage for supplying a signal pressure to the light load control chamber, wherein the light load supply passage communicates with a flow path for fuel between a source of fuel at transfer pressure and a low pressure drain, and a light load control valve arrangement which is operable in response to a load dependent control signal to vary the rate of flow of fuel through the flow path and, hence, to vary the signal pressure, thereby to permit the timing under light load conditions to be adjusted, wherein the light load control valve arrangement is arranged in the flow path at a position upstream of the light load supply passage.

The light load control chamber may be provided with a restricted outlet arrangement to permit fuel within the light load control chamber to flow to a low pressure fuel reservoir at a restricted rate. The advance arrangement may further comprise a further adjustment arrangement for adjusting the effective restriction to fuel flow provided by the restricted outlet arrangement.

Preferably, the restricted outlet arrangement comprises a first restricted outlet having a variable diameter, and a second restricted outlet of substantially fixed diameter, whereby the further adjustment arrangement is adjustable to vary the diameter of the first restricted outlet.

The further adjustment arrangement may include a valve member arranged within an additional bore, whereby adjusting the position of the valve member within the additional bore permits the diameter of the first restricted outlet to be varied.

Conveniently, the first restricted outlet is of annular form and is defined, in part, by the valve member.

In one embodiment of the invention, the servo piston is arranged to carry a sleeve, conveniently forming a close fit on the servo piston, wherein the sleeve is provided with an orifice to restrict the rate of flow of fuel between the light load control chamber and the servo piston chamber, and serving to damp movement of the servo piston relative to the light load piston.

Figure 2:
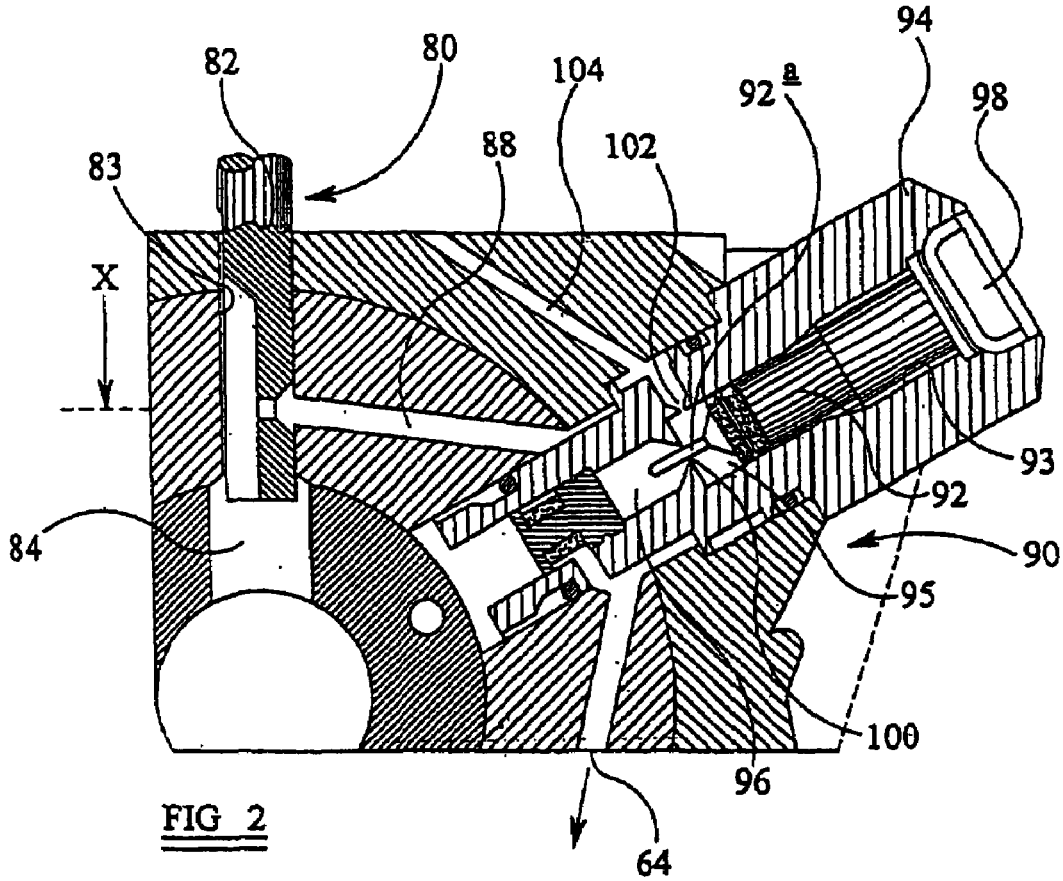
FIG 2 Prior Art
Figure 3:
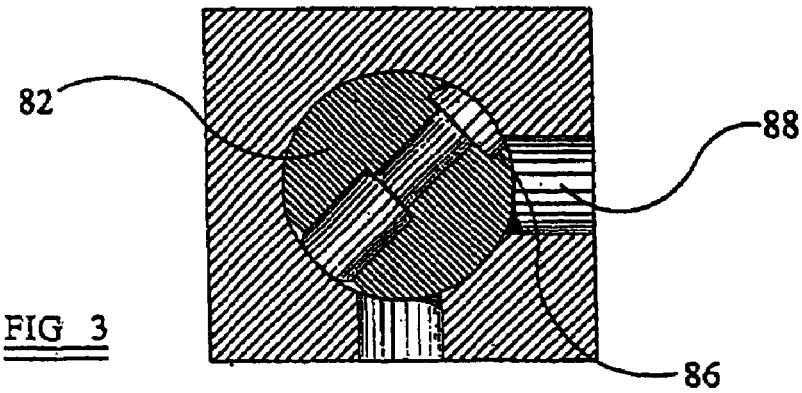
FIG 3 Prior Art
Figure 4:
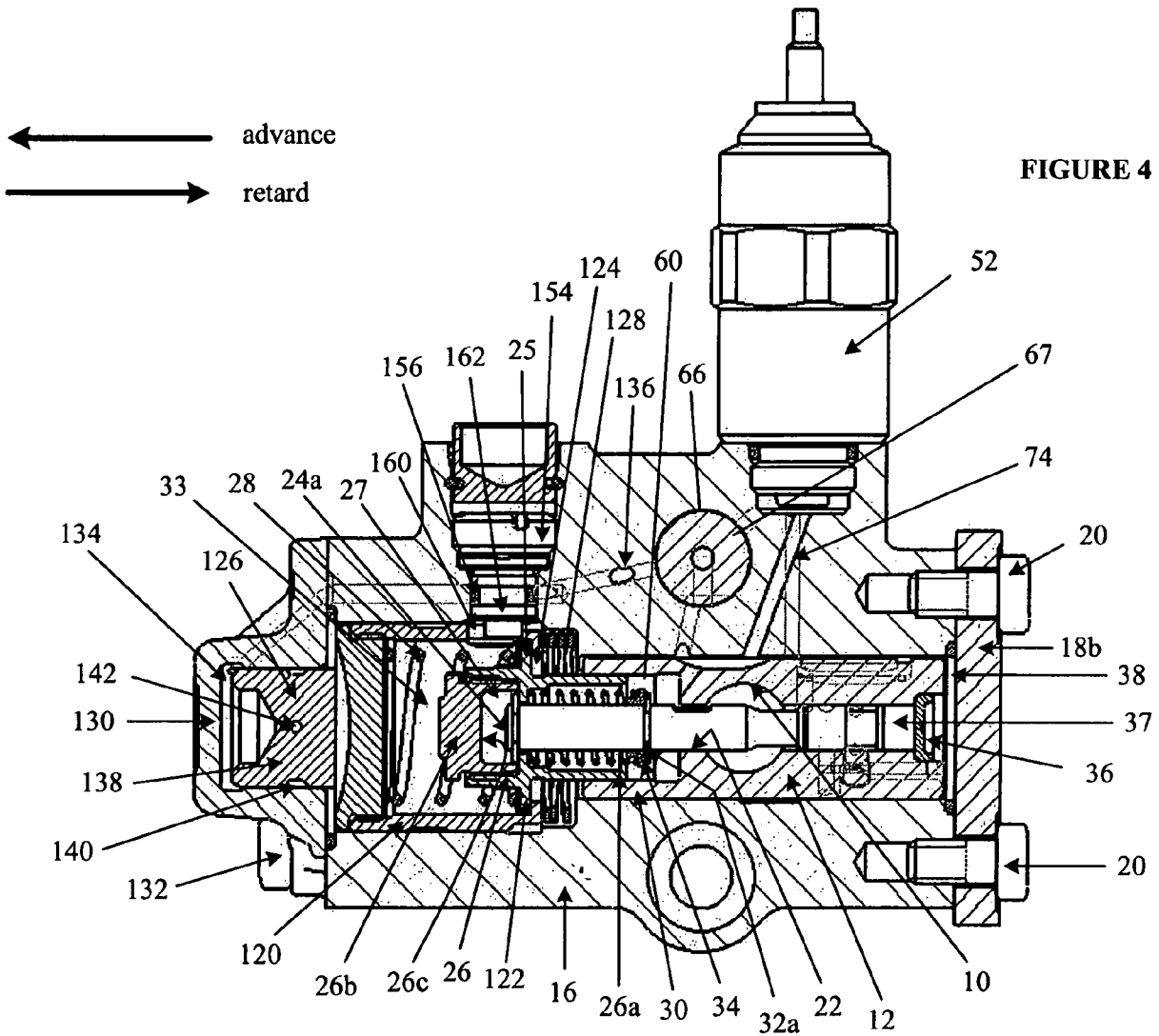
Figure 5:
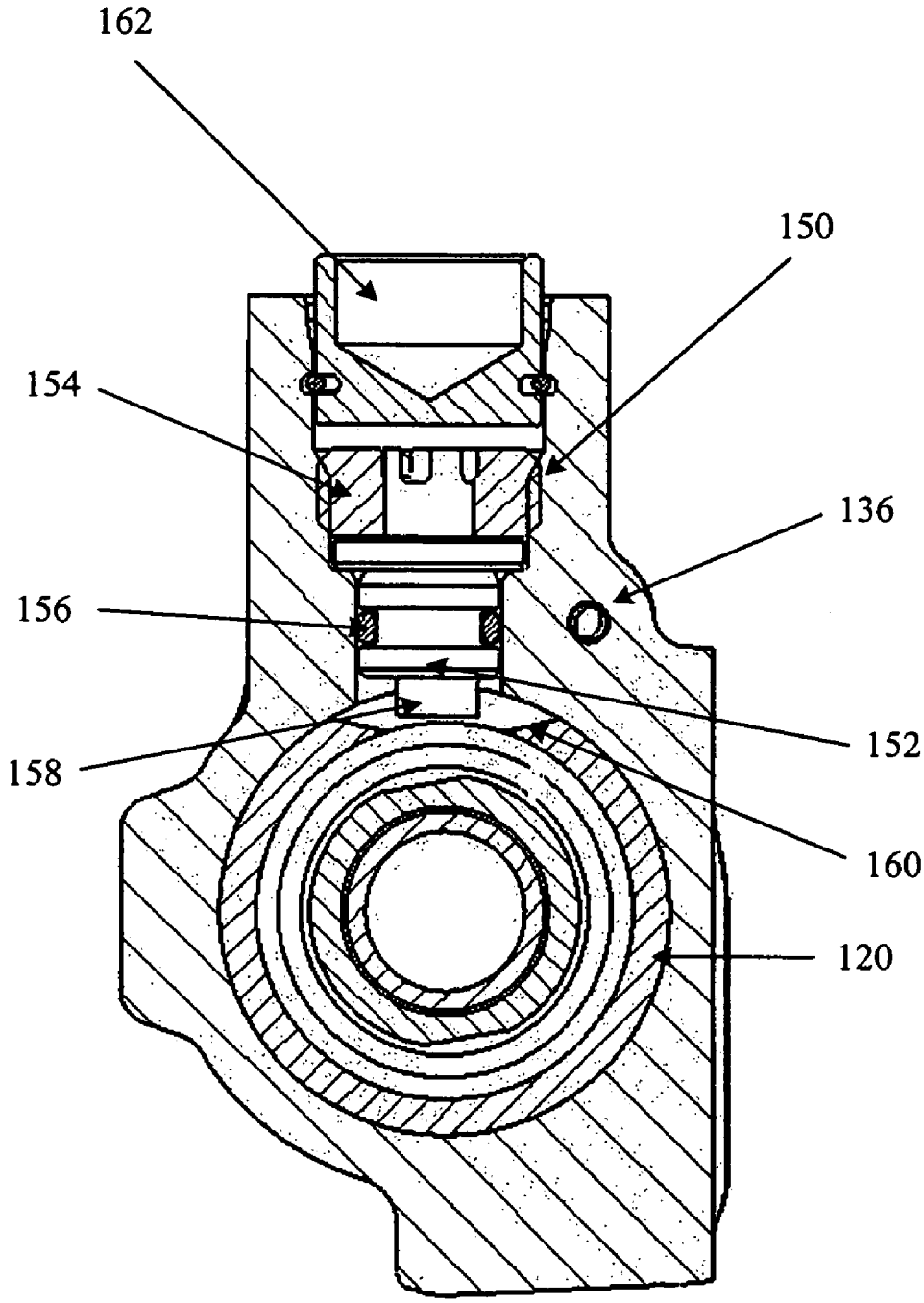
Figure 6:
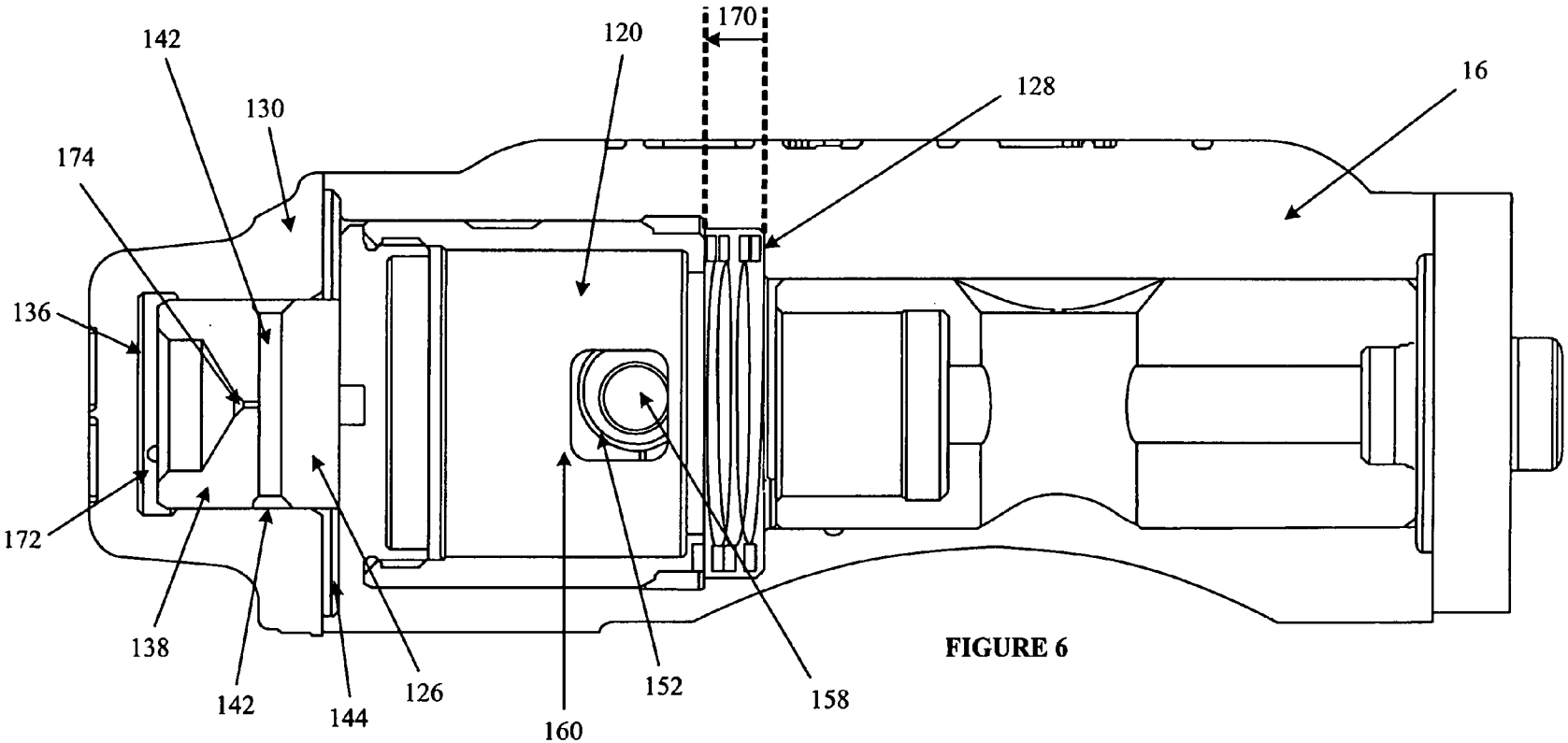
Figure 7:
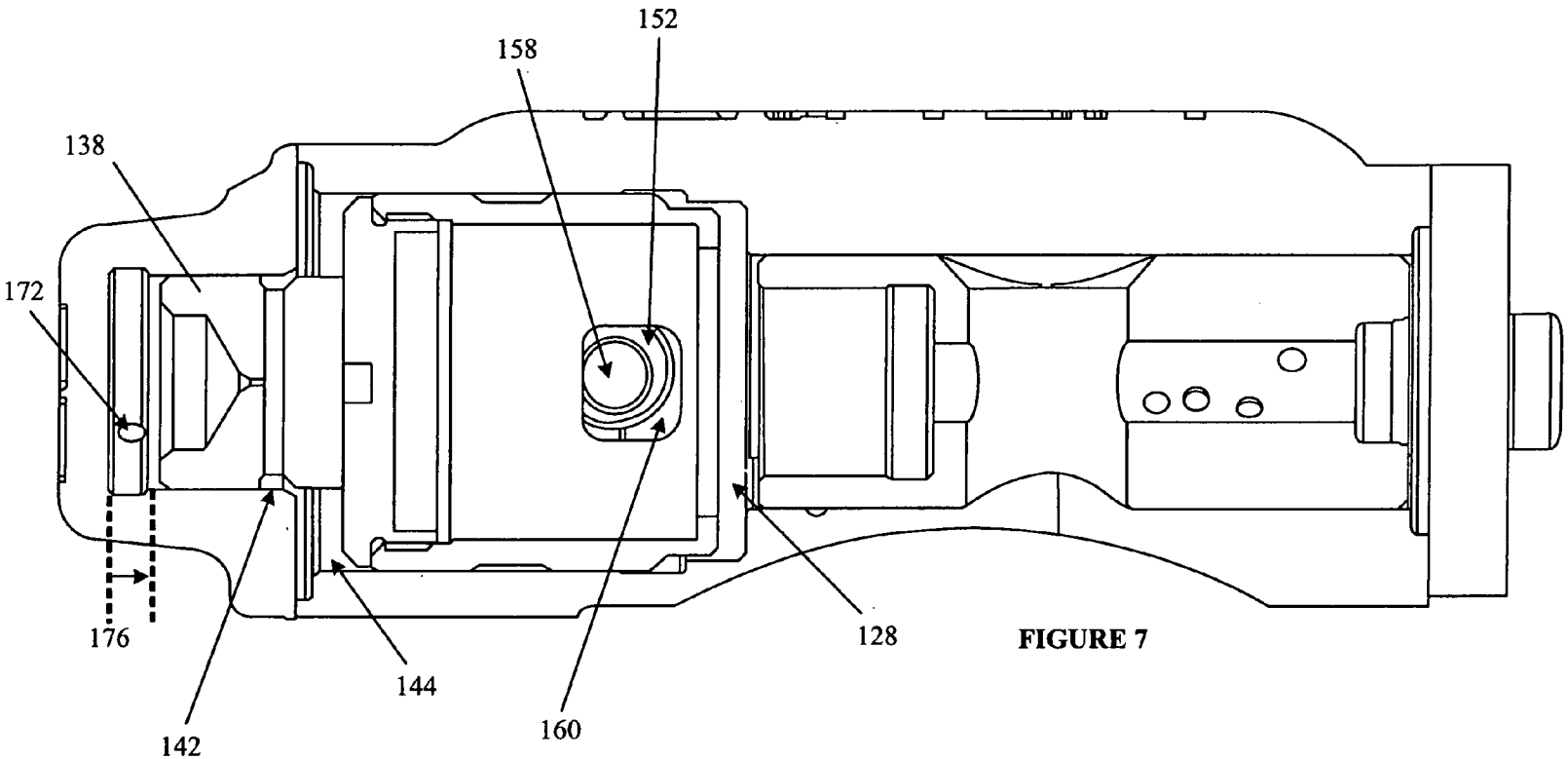

The invention will further be described, by way of example, with reference to the accompanying drawings, in which:

FIG. 1 is a view, part in section, of a prior art advance arrangement,

FIG. 2 is a sectional view of a part of the advance arrangement shown in FIG. 1, FIG. 3 is a sectional view, along line X-X, showing a part of the advance arrangement in FIG. 2, FIG. 4 is a view of an advance arrangement in accordance with a first embodiment of the present invention, FIG. 5 is a section view of a part of the advance arrangement shown in FIG. 4, FIG. 6 is a view of the advance arrangement of FIG. 4 in an advanced position, and FIG. 7 is a view of the advance arrangement of FIG. 4 in a normal running position.

A conventional rotary fuel pump includes a cam ring (not shown) which is angularly adjustable with respect to a pump housing. The cam ring includes a plurality of cam lobes and encircles part of a distributor member, including pumping plungers which are slidable within respective bores of the distributor member. Each of the pumping plungers has an associated shoe and roller arrangement, the rollers of which are engagable with the cam surface of the cam ring. In use, fuel is supplied to the bores of the distributor member by a transfer pump and a force due to fuel pressure within the bores serves to urge the plungers in a radially outward direction. The output pressure of the transfer pump (referred to as "transfer pressure") is controlled so as to be related to the speed of operation of the engine with which the pump is being used. Rotation of the distributor member relative to the cam ring causes the rollers to move relative to the cam ring, engagement between the rollers and the cam lobes thereby causing the plungers to be forced in a radially inward direction to pressurise fuel within the respective bore and causing fuel to be delivered by the pump at relatively high pressure. By altering the angular position of the cam ring by means of an advance arrangement, the timing at which fuel is delivered by the pump can be adjusted.

As will be described in further detail hereinafter, the advance arrangement includes a servo piston arrangement which is arranged to influence the degree of timing advance depending on the operating speed of the engine (referred to as "speed advance"), a light load piston arrangement, including a load sensing piston, which is arranged to influence the degree of timing advance depending on the load under which the engine is operating (referred to as "light load advance") and a temperature control valve which is arranged to influence the degree of timing advance depending on the operating temperature of the engine (referred to as "cold advance").

FIG. 1 shows an embodiment of the present invention in which the cam ring is provided with a peg (not shown) which extends into an opening 10 provided in an advance piston 12 in order to permit adjustment of the angular position of the cam ring. The advance piston 12 is slidable within a further bore 14 provided in an advance box housing 16. The ends of the bore 14 are closed by first and second end plates 18*a* 18*b* respectively which are secured to the advance box housing 16 by means of bolts 20. Appropriate O-rings may be used to seal the end plates 18*a* 18*b* to the advance box housing 16.

The advance piston 12 includes an axially extending bore 22 within which a servo piston 24 is slidable. The bore 22 is shaped to include an enlarged region within which a first part 26*a* of a light load sensing piston 26 is received. The first part of the light load piston 26 carries a flange 25, an inner portion of which defines a central opening through which the servo piston 24 extends. The servo piston 24 is a sliding fit within this central opening, and within the bore 22 provided in the advance piston 12, and acts to guide movement of the light load piston 26, in use. The light load piston 26 also includes a second part 26*b* typically in the form of a screw threaded piece, which is received within a screw threaded bore in the first part 26*a* of the light load piston 26. The second part 26*a* of the light load piston is provided with a blind bore, a surface 26*c* at the blind end of the bore defining, together with an end surface of the servo piston 24, a servo piston chamber 27 at a first end of the servo piston 24. An annular clearance 29 is defined between an outer surface of the servo piston 24 and an inner surface of the first part 26*a* of the light load piston 26 to permit communication between the servo piston chamber 27 and a light load control chamber 60, as will be described in further detail below.

A light load control spring 28 is arranged within an end chamber 33 defined, in part, by the bore 12 in the advance box housing 16 and the first end plate 18*a* the light load control spring 28 being engaged between the light load piston 26 and the first end plate 18*a* to bias the light load piston 26 into engagement with a step 14*a* defined by part of the bore 14. A servo control spring 30 is engaged between the light load piston 26 and a first annular member 32*a* carried by the servo piston 24. A shim 34 is located between the servo control spring 30 and the first annular member 32. The servo piston 24 also includes an enlarged end region 24*a* which defines an end surface of the servo piston 24, the end region 24*a* being in abutment with a second annular member 32*b* carried by the servo piston which, in the position shown in FIG. 1, abuts an axially facing surface the inner portion of the flange on the first light load piston part 26*a*. The maximum permitted movement of the servo piston 24 relative to the light load piston 26 occurs when an end surface of the servo piston 24 engages the end surface 26*c* of the blind bore in the second part 26*b* of the light load piston 26.

The position of the second part 26*b* of the light load piston 26 relative to the first part 26*a* determines the extent of travel of the composite light load piston 26, the extent of travel being defined by the gap between the end of the second part 26*b* of the light load piston 26 and the end plate 18*b*. It will therefore be appreciated that the extent to which the second part 26*b* of the light load piston 26 is screwed into the first part 26*a* will determine the extent of travel of the servo piston 24 and of the light load piston 26. The formation of the light load piston 26 in two parts which are axially movable relative to one another therefore provides an adjustment arrangement for adjusting the extent of travel of the light load piston 26 and the servo piston 24. It will also be appreciated that the position of the light load piston 26 relative to the end plate 18*a* determines the maximum permitted level of advance.

In practice, it may be desirable to provide the light load piston 26*a*, 26*b* with a seal arrangement (not shown), typically in the form of an O-ring, to provide a substantially fluid-tight seal between the servo piston chamber 37 and the end chamber 33. A locking arrangement (not shown), typically in the form of a locking nut, may also be provided to secure the first and second parts 26*a*. 26*b* of the light load piston 26 in position on assembly of the arrangement. In an alternative embodiment, the friction of the O-ring seal may be sufficient to ensure the first and second parts 26*a*, 26*b* are secured together, in which case the need for the locking arrangement is removed.

At the end of the bore 22 remote from the light load piston 26, a disc-shaped member 36 is arranged within an annular groove provided in the advance piston 12. Movement of the servo piston 24 relative to the advance piston 12 is limited by engagement between the first annular member 32 and a part of the bore 22 provided in the advance piston 12. The disc-shaped member 36 defines, together with a part of the bore 22 provided in the advance piston 12, a servo control chamber 37 at a second end of the servo piston 24 for receiving fuel, a force due to fuel pressure within the servo control chamber 37 acting on the end surface of the enlarged region 24*a* of the servo piston 24 so as to urge the servo piston 24 towards the left in the illustration shown in FIG. 1 against the force due to the servo control spring 30. Fuel is delivered to the servo control chamber 37 through a servo supply passage 50 provided in the advance box housing 16. For the purpose of this specification, the pressure of fuel within the servo control chamber 37 shall be referred to as "servo control pressure", the servo control pressure being dependent upon the speed at which the engine operates.

A first control chamber 38 is defined by an end face of the advance piston 12 remote from the light load piston 26, the associated part of the bore 14 and the second end plate 18*b*. The first control chamber 38 communicates, via a channel 46 formed in the outer periphery of the advance piston 12, with a radially extending passage 42 within which a non-return valve (not shown) is located. The radially extending passage 42 communicates with the bore 22 in the advance piston 12 and, depending on the position of the servo piston 24, the radially extending passage 42 may communicate with a second radially extending passage 44 provided in the advance piston 12. The second radially extending passage 44 opens into a recess 48 provided in the outer surface of the advance piston 12. The recess 48 is located so that for all permitted positions of the advance piston 12 relative to the advance box housing 16, the recess 48 communicates with the servo supply passage 50 defined in the advance box housing 16.

As mentioned previously, the advance piston 12 and the light load piston 26 together define a light load control chamber 60 within which the servo control spring 30 is arranged, the light load control chamber 60 being in constant communication, by means of the clearance 29, with the servo piston chamber 27 at the left hand end of the servo piston 24 (in the orientation shown in FIG. 1). The light load control chamber 60 also communicates with an additional recess 62 provided in the outer surface of the advance piston 12. The additional recess 62 is arranged such that, for all permitted positions of the advance piston 12, the additional recess 62 communicates with a light load supply passage 64. The light load supply passage 64 communicates with a bore 66 provided in the advance box housing 16 such that fuel can be delivered to the light load control chamber 60, in use, and hence to the servo piston chamber 27, the pressure of fuel delivered to the light load control chamber 60 (referred to as "signal pressure") depending upon the load under which the engine operates.

The bore 66 receives a passage defining member 67 which ensures a second supply passage 68 defined in the advance box housing 16 communicates constantly with fuel at transfer pressure. In use, fuel at transfer pressure is supplied through the second supply passage 68, from where it flows into the servo supply passage 50.

The additional recess 62 provided on the outer surface of the advance piston 12 defines a control edge 72 and, depending on the axial position of the advance piston 12, may communicate with a cold advance supply passage 74 defined in the advance box housing 16. An electro-magnetically operated temperature control valve 52 is mounted upon the cam box housing 16 to control the supply of fuel through the cold advance supply passage 74. Typically, the temperature control valve 52 takes the form of a conventional stop solenoid, supplied with electrical current only when the engine is at a relatively low temperature. The temperature control valve 52 is therefore only in an open position when the engine is cold. Conveniently, activation of the temperature control valve 52 is controlled by means of a temperature sensor arranged to sense the temperature of the engine water jacket.

Under normal operating conditions, where the engine is hot, the temperature control valve 52 is closed such that fuel at transfer pressure is supplied only through the second supply passage 65, but is not supplied through the temperature control valve 52 to the cold advance supply passage 74.

In use, fuel delivered through the light load supply passage 64 to the light load control chamber 60 acts on the light load piston 26 to oppose the force due to the light load control spring 28. If signal pressure in the light load control chamber 60 is relatively low, the light load piston 26 is biased by means of the light load spring 28 into engagement with the step 14*a* defined by the bore 14. However, if fuel pressure within the light load control chamber 60 is increased sufficiently, the light load piston member 26 will be urged away from the step 14*a* into the position shown in FIG. 1, such that the advance characteristic is altered.

The pressure of fuel supplied through the light load supply passage 64 to the additional recess 62 is regulated by means of a metering valve arrangement 80, as shown in FIGS. 2 and 3. The metering valve arrangement 80 therefore controls the pressure of fuel within the light load control chamber 60 which controls the position of the light load piston 26 relative to the advance piston 12.

The metering valve arrangement 80 includes a metering valve member 82 arranged within a metering valve bore 83. The angular position of the metering valve member 82 within the bore 83 is adjustable in response to a load dependent control signal to vary the rate of flow of fuel through an inlet passage 84, arranged to receive fuel at transfer pressure, to an outlet passage 88 in communication with the light load supply passage 64. The metering valve member 82 is provided with a drilling which defines a control edge 86, the amount of fuel flowing through the metering valve arrangement 80, and hence the pressure of fuel supplied to the light load supply passage 64 to be delivered to the light load control chamber 60, being determined by the position of the control edge 86 relative to the outlet passage 88.

Fuel flowing from the outlet passage 88 to the light load supply passage 64 flows through an adjustable valve arrangement, referred to generally as 90, including a valve member 92 arranged within a further bore 93 which defines a chamber 95. The valve member 92 is in screw threaded connection with the further bore 93 such that the axial position of the valve member 92 within the further bore 93 is adjustable. The further bore 93 is shaped to define a part of a branch flow passage 96 for fuel between the outlet passage 88 and the light load supply passage 64. The further bore 93 is also shaped to include a region of relatively small diameter through which a projecting region 92*a* of the valve member 92 extends. It will be appreciated that the position of the projecting region 92*a* of the valve member 92 relative to the region of relatively small diameter can be adjusted by adjusting the position of the valve member 92 within the further bore 93.

The projecting region 92*a* of the valve member 92 and the region of relatively small diameter in the flow passage 96 together define an annular outlet 100 of restricted diameter. The chamber 95 communicates, by means of a further restricted outlet 102 arranged in series with the annular outlet 100, with a relief passage 104 in communication with a low pressure fuel reservoir. Typically, the cam box is at relatively low pressure (commonly referred to as "cam box pressure") such that the relief passage 104 is in communication with the cam box. It will be appreciated, however, that the cam box need not be at relatively low pressure, for example it may be at transfer pressure, in which case the relief passage 104 communicates with an alternative low pressure reservoir. As fuel flows through the passages 88, 96 into the light load supply passage 64, a small amount of fuel is also able to flow, at a relatively low rate, through the annular outlet 100, into the chamber 95 and through the further restricted outlet 102 to the cam box. The annular outlet 100 and the further restricted outlet 102 therefore form a restricted outlet arrangement, the rate at which fuel is able to flow to the cam box being determined by the effective restriction to fuel flow provided by the restricted outlet arrangement 100, 102. It will therefore be appreciated that the effective restriction to fuel flow provided by the restricted outlet arrangement 100, 102 is determined by the position of the valve member 92 within the bore 93.

As an alternative to that shown in FIGS. 2 and 3, it may be more convenient to define the control edge 86 by means of an axially extending recess or slot provided on the surface of the metering valve member 82, rather than by providing a radially extending drilling through the member 82.

FIG. 4 shows an advance arrangement in accordance with the present invention. As can be seen the advance arrangement has a number of similarities with the advance arrangement described in relation to FIG. 1. Like features between the two advance arrangements have therefore been denoted with like features. It is also noted that the general operation of the advance arrangement of FIG. 4 is similar to that of the arrangement of FIG. 1.

The advance arrangement of FIG. 4 additionally comprises a cold cranking advance mechanism which in use is operative to advance the engine by a predetermined amount prior to engine start up in order to overcome the cold starting performance issues associated with engines operating under the Tier 3 level emission regulations.

Turning to FIG. 4 the advance arrangement also comprises a cold cranking sleeve 120 which surrounds the light load control spring (28) and light load piston (26). The sleeve 120 comprises an annular portion 122 at one end which defines a central opening 124 through which the light load piston extends. A cold cranking plug 126 closes off a second end of the sleeve 120.

The annular portion 122 of the sleeve abuts and is attached to the flange 25 carried by the light load piston 26.

A cold cranking control spring 128 is located between the annular portion of the sleeve and a step 14*a* defined by part of the bore 14. The spring serves to bias the cold cranking sleeve away from the step 14*a*.

The light load control spring 28 is, in contrast to FIG. 1, arranged within a chamber 33 defined in part, by the bore 14 in the advance box housing and the cold cranking plug 126, the light load control spring 28 being engaged between the light load piston 26 and the plug 126 to bias the light load piston towards the step 14*a* defined by part of the bore 14.

As in FIG. 1, one end of the bore 14 is closed by the end plate 18*b*. The other end of the bore 14 is however in FIG. 4 closed by a cold cranking advance housing 130 which is secured to the advance box housing 16 by means of bolts 132.

The cold cranking housing 130 defines a cold cranking control chamber 134 which communicates with a cold cranking supply passage (an angled section of which is shown as feature 136). The cold cranking supply passage 136 communicates with the bore 66 provided in the advance box housing 16 such that fuel can be delivered to the cranking control chamber 134 in use, the pressure of fuel delivered to the cranking control chamber depending upon the load under which the engine operates.

A cold cranking advance piston 138 is provided within the cranking control chamber 134. The cold cranking piston 138 is slidable within the housing and abuts the cold cranking plug 126 (on the opposite side of the plug to the light load control spring 28).

An annular recess 140 is provided on the surface of the cranking advance piston and this recess is in communication with the cold cranking control chamber via a cross hole drilling 142 within the body of the cranking advance piston.

A further chamber 144 exists between the cold cranking plug 126 and the cold cranking piston 138.

Prior to engine start up the cold cranking control spring 128 acts to move the cold cranking sleeve 120 by a predetermined distance into an advance position. Since the sleeve 120 is in communication with the light load piston 26 and the light load piston 26 in turn is in communication with the servo/advance pistons 24/12, the cold cranking control spring 128 therefore acts to move the whole advance arrangement into an advance position. The "predetermined distance" in the present invention is usually between two and four degrees of advance of the advance piston (where one degree of advance of the main piston equates to around 0.8 mm).

Upon engine start up therefore the advance arrangement is in a position which allows cold starting of the engine. This arrangement overcomes the problems stated above and allows is sufficient to provide the required cold starting performance to a Tier 3 engine.

After engine startup the fuel injection pump generates a transfer pressure signal which delivers fuel through the cold cranking supply passage 136 to the cold cranking control chamber 134. The pre-load of the cold cranking advance spring 128 is set such that at a certain speed the transfer pressure acting on the cold cranking advance piston is sufficient to cause the cold cranking sleeve to move back (i.e. in the retard direction) towards the normal running position of the advance arrangement (i.e. back towards the datum setting from which the advance arrangement adjusts fuel injection timing).

When the cold cranking piston has moved in the retard direction by a small amount the annular recess 140 in the piston comes into communication with the further chamber 144. This allows fuel to flow from the cranking advance control chamber through the cross hole drilling in the piston into the further chamber 144.

The fuel entering the further chamber 144 acts upon the cold cranking plug 126. The area presented by the plug surface is greater than that presented by the surface of the piston and therefore the transfer pressure acting on the plug has the effect of firmly pushing the advance capsule in the retard direction and therefore returning the advance arrangement into its normal running position.

It is noted that the return of the advance arrangement to its normal running position is essentially a two stage process. The first stage occurs when the fuel pressure acts on the cold cranking piston alone. The second stage occurs after the piston has moved sufficiently to allow the fuel to enter the further chamber 144 and act additionally on the cold cranking plug.

Conventionally, setting of the timing datum for fuel injection is effected by adjusting the physical position of the pump housing relative to the internal combustion engine about the axis of rotation of the drive arrangement for the pump. In essence the pump housing is adjusted angularly about the axis of rotation of the pump drive arrangement and is then cramped in an adjusted position by bolts which secure the pump housing to the internal combustion engine. As mentioned above such an arrangement is disadvantageous. As also noted above EP 1035311 describes a dynamic timing adjustor in which an externally accessible, adjustable abutment cooperates with the light load piston to permit setting of a rest position of the light load piston relative to the housing of the advance arrangement and thereby to permit adjustment, from the exterior of said housing, of the datum setting from which the advance arrangement adjusts fuel injection timing. This arrangement is, however, disadvantaged by the fact that the timing adjustment alters the pre load of the light load spring which can have detrimental effects on engine performance. FIG. 4 additionally illustrates a modified dynamic timing adjustment arrangement in which adjustment of the timing datum can be effected simply and conveniently.

It can be seen in FIG. 4 that the wall of the housing 16 is formed with a stepped transverse bore 150 within which an abutment member 152 is rotatably received. The abutment member 152 is retained in an inner narrower region of the bore 150 by a locking nut 154 in screw threaded engagement with the wall of an outer wider region of the bore 150 and the rotating interface of the member 152 and the bore 150 is sealed by an O-ring seal 156 carried in a groove of the member 154 and engaging the plain wall of said inner region of the bore 150.

The axis of rotation of the member 152 extends at right angles to, and intersects the common longitudinal axis of the light load piston 26 and the advance piston 12 and the member 152 includes an eccentric post 158 which projects parallel to the axis of the member 152 and is engageable with a slot 160 in the sleeve 120.

The post 158 is of circular cross section and its axis is parallel to, but spaced laterally from, the axis of rotation of the remainder of the member 152. The post 158 forms an abutment against which an edge of the slot 160 engages under the action of the spring 28, and thus defines the rest position of the cold cranking sleeve 120.

Rotation of the member 152 in the housing 15 adjusts the axial location of the normal running position of the cold cranking sleeve 120 and therefore the position of the whole advance arrangement. The outer end of the member 152, which is accessible from the exterior of the housing 16 through the central aperture of the locking nut 154, is provided with a recess 162 shaped for receiving an adjustment tool.

The timing datum for the pump with which the advance arrangement is associated is defined by the normal running position of the capsule sleeve 120 within the housing 16 (i.e. by the position of the sleeve 120 once fuel pressure variations have moved the sleeve back in the retard direction and once the spring 128 has reached maximum compression). Thus rotation of the member 152 through an appropriate 180° arc displaces the normal running position of the cold cranking sleeve 120 between maximum and minimum positions. The actual distance between the maximum and minimum positions is of course determined by the eccentricity of the post 158 relative to the axis of the member 152 and conveniently the eccentricity can be of the order of 0.4 mm giving a total throw of 0.8 mm and thus an adjustment of the datum position of plus or minus 0.4 mm from a central position of the adjustable abutment member 152.

In use, the advance arrangement will be assembled with the member 152 in its intermediate position so that after the adjuster and injection pump have been assembled to the associated internal combustion engine the member 152 can be turned in one direction or the other to give the appropriate adjustment of the timing datum of the normal running position without the need to physically alter the position of the pump housing relative to the internal combustion engine.

It will be recognised that if desired the eccentric post 158 could be replaced by some form of cam shaping at the inner end of the member 152 to cooperate with the sleeve 120 to achieve a desired range and characteristic of adjustment.

FIG. 5 shows the dynamic timing adjustment arrangement described in relation to FIG. 4 from a different section angle. Like features have once again been labelled with like numerals.

It is noted that in contrast to the dynamic timing adjustment device shown in EP 1035311 the post 158 acts upon the capsule sleeve 120 of the cold cranking advance arrangement. Therefore, adjusting the datum setting of the advance arrangement in the present invention does not alter the pre-load of the light load spring 28. Instead the whole advance arrangement (e.g. light load piston, light load spring, advance piston 12 and servo piston 24) is moved relative to the housing 16 thereby preserving the pre-loading of the components within the advance arrangement.

FIGS. 6 and 7 illustrate the movement of the various components of the advance arrangement as the device moves between the cold cranking advance position and the normal running position.

FIG. 6 shows the advance arrangement in the cold cranking advance position (i.e. the arrangement prior to engine start-up). It can be seen that the cold cranking control spring 128 is in an extended position. As the spring 128 is in an extended position, the cold cranking sleeve 120 has been displaced from its normal running position into the advance direction by a predetermined distance (indicated by numeral 170). This shifting of the advance arrangement prior to engine start up is by a predetermined amount. However, usually the cold cranking advance will be in the region of two to four degrees of advance.

In the position shown in FIG. 6 the piston 138 is located in the housing 130 such that the annular recess 140 is not in fluid communication with the further chamber 144 between the piston 138 and the capsule plug 126.

It is further noted that the eccentric post 158 carried on the abutment member 152 of the dynamic timing adjuster abuts the side of the slot 160 which is closest to the cold cranking spring 128.

In use, the engine is started and fuel is supplied under pressure to the cold cranking supply chamber 134 via a supply passage through the housing 16. The exit hole 172 of this passage is visible in FIG. 6 (although partially obscured by the piston 138). Fuel entering the supply passage acts upon the surface of the piston 138. As the pressure of the fuel within the chamber 134 increases it will begin to overcome the force exerted by the spring 128 on the advance arrangement. This will in turn act to return the arrangement in the retard direction.

Fuel entering the chamber 134 enters the cross hole drilling 142 in the piston 138 via an orifice 174 and in turn enters the volume defined by the annular recess 140. Due to the advanced position of the advance arrangement (and therefore the piston 138) the annular recess is not in fluid communication with the further chamber 144. The speed of movement of the advance arrangement in the retard direction is therefore initially small.

As the piston 138 moves in the retard direction (towards the advance arrangement's normal running position) the annular recess will come into fluid communication with the further chamber 144. At this point the fuel supplied via the supply passage will be able to act upon both the cold cranking advance piston 138 and also the larger area presented by the cold cranking plug 126. The speed of movement of the advance arrangement will therefore increase compared to the initial speed of movement of the piston 138 as described above.

It is noted that the flow of fuel into the further chamber 144 can be regulated by appropriately sizing the orifice 174. If the orifice 174 is made as large as the cross hole drilling 142 then fuel will more easily enter the drilling 142 than if the orifice was smaller.

FIG. 7 illustrates the advance arrangement after it has returned to its normal running position. The cold cranking control spring 128 is now in a state of compression and the advance arrangement has moved back in the retard direction by a distance equal to the cold cranking advance displacement. The relative displacement of the cranking advance piston 138 is indicated by reference numeral 176.

It is noted that in the position depicted in FIG. 7 the annular recess 142 is now in fluid communication with the further chamber 144.

It is further noted that the eccentric post 158 carried on the abutment member 152 is now abutting the side of the slot 160 that is furthest from the spring 128.

The position shown in FIG. 7 represents the normal running position of the engine. This is therefore the datum position from which the advance arrangement adjusts fuel injection timing. Minor adjustments to the rest position of the advance arrangement can be made by rotating the member 152 as described above. This enables an adjustment equal to roughly ±½° of advance to be made once the engine has been installed (as described above).

As noted above the movement of the cold cranking arrangement back to the normal running position is a two stage action (initially fuel acts only on piston 138 and then later on both the piston 138 and plug 126). The reasons for designing the cold cranking arrangement in this way are two fold. Firstly, as the sleeve 120 returns to the normal running position the side wall of the slot 160 will impact upon the post 158. These impact forces are minimised by the two stage action (if the fuel acted on the plug 126 throughout the whole procedure then the sleeve 120 would move faster and the loading on the post 158 would increase). Secondly, by designing the cold cranking advance in the manner described above the space requirements of the various components are reduced.

Although the description hereinbefore is of a fuel pump of the type in which pumping plungers move in a radial direction in order to supply fuel at high pressure to an engine, it will be appreciated that the advance arrangement may be applicable to other types of high pressure fuel pump.

The invention claimed is:

1. An advance arrangement for use in controlling timing of fuel delivery by a fuel pump for use in an engine comprising;

an advance piston (12) which is slidable within a first bore (14) and which cooperates, in use, with a cam arrangement of a fuel pump to adjust the timing of fuel delivery by the pump, a surface associated with the advance piston (12) being exposed to fuel pressure within a first control chamber (38) and the advance piston (12) being slidable within the first bore (14) in either an advance or a retard direction to advance or retard, respectively, the timing of the fuel pump delivery, a servo piston (24) which is slidable within a further bore (22) provided in the advance piston (12) to control the pressure of fuel within the first control chamber (38), the servo piston (24) being responsive to speed dependent fuel pressure variations within a servo control chamber (37), thereby to permit adjustment of the timing in response to engine speed, and a light load piston (26) moveable relative to the advance piston (12) against the action of a light load control spring (28) in response to fuel pressure variations within a light load control chamber (60), wherein the light load piston (26) is carried within a cold cranking sleeve (120), the cold cranking sleeve (120) being slidable within the first bore (14) against the action of a cold cranking control spring (128) in response to fuel pressure variations within a cold cranking control chamber (134) such that the cranking control spring (128) acts, in use, to slide the cold cranking sleeve (120) a predetermined distance in the advance direction and fuel pressure variations within the control chamber (134) serve to slide the cold cranking sleeve (120) back in the retard direction.

2. An advance arrangement as claimed in claim 1 wherein in use the fuel pressure variations slide the cold cranking sleeve (120) back to a normal running position from which the advance arrangement adjusts fuel injection timing.

3. An advance arrangement as claimed in claim 1 wherein the predetermined distance is between 2 and 4 degrees of advance of the advance arrangement.

4. An advance arrangement as claimed in claim 3 wherein the advance arrangement comprises a housing (16), the housing supporting an externally accessible, adjustable abutment (152) which cooperates with the cold cranking sleeve (120) to permit setting of the normal running position relative to said housing (16) and thereby to permit adjustment, from the exterior of said housing (16), of the datum setting from which the advance arrangement adjusts fuel injection timing.

5. An advance arrangement as claimed in claim 4 wherein the abutment member (152) comprises a post (158) and the cold cranking sleeve (120) comprises a slot (160), the post and the slot cooperating to permit the setting of the normal running position.

6. An advance arrangement as claimed in claim 1 wherein the cranking control spring (128) is at a first end of the cold cranking sleeve (120) and acts upon a step (14*a*) in the first bore (14) to bias the cold cranking sleeve (120) in the advance direction.

7. An advance arrangement as claimed in claim 1 wherein the first bore (14) is provided in a housing (16) and is closed at a one end by a cold cranking advance housing (130), the advance arrangement further comprising a cold cranking advance piston (138) which is slidable within the cold cranking advance housing (130) and is operably connected with a second end of the cold cranking sleeve (120), the cold cranking advance piston (138) and the cold cranking advance housing (130) defining the cold cranking chamber (134).

8. An advance arrangement as claimed in claim 7 wherein the second end of the cold cranking sleeve (120) is closed by a cold cranking plug (126), the cold cranking plug (126) being in communication with the cold cranking advance piston (138).

9. An advance arrangement as claimed in claim 7 wherein the cold cranking plug (126), the first bore (14) and the cold cranking advance housing (130) define a further chamber (144) which, depending on the position of the cold cranking advance piston (138) in the cold cranking advance housing (130), can be in fluid communication with the cold cranking control chamber (134).

10. An advance arrangement as claimed in claim 9 wherein said fluid communication between the cold cranking control chamber (134) and the further chamber (144) is provided by means of a restricted outlet arrangement (140, 142) which, depending on the position of the cold cranking piston (138) in the cold cranking advance housing (130), permits fuel within the cold cranking control chamber (134) to flow into the further chamber (144).

11. An advance arrangement as claimed in claim 8 wherein the cold cranking plug (126), the first bore (14) and the cold cranking advance housing (130) define a further chamber (144) which, depending on the position of the cold cranking advance piston (138) in the cold cranking advance housing (130), can be in fluid communication with the cold cranking control chamber (134).

12. An advance arrangement as claimed in claim 11 wherein said fluid communication between the cold cranking control chamber (134) and the further chamber (144) is provided by means of a restricted outlet arrangement (140, 142) which, depending on the position of the cold cranking advance piston (138) in the cold cranking advance housing (130), permits fuel within the cold cranking control chamber (134) to flow into the further chamber (144).

* * * * *